US005676637A

United States Patent [19]

Lee

[11] Patent Number: 5,676,637

[45] Date of Patent: Oct. 14, 1997

[54] PHYSICAL THERAPEUTIC INSTRUMENT FOR PREVENTION AND TREATMENT OF HEMORRHOIDS

[76] Inventor: Hyung Jun Lee, 29-1 Shinsul-dong, Dongdaemoon-Ku, Seoul, Rep. of Korea

[21] Appl. No.: 355,192

[22] Filed: Dec. 8, 1994

[30] Foreign Application Priority Data

| | | | |
|---|---|---|---|
| Dec. 8, 1993 | [KR] | Rep. of Korea | 93-26795 |
| Nov. 11, 1994 | [KR] | Rep. of Korea | 94-29632 |

[51] Int. Cl.[6] ..... A61H 21/00; A61H 1/00

[52] U.S. Cl. ..... 601/15; 601/70; 601/49; 601/51; 601/134

[58] Field of Search ..... 607/113, 138; 601/29–31, 15, 69, 70, 100, 49–54, 78, 89, 108–113, 115–117, 134, 136, 84; 600/38

[56] References Cited

U.S. PATENT DOCUMENTS

| | | | |
|---|---|---|---|
| 781,885 | 2/1905 | Jackson | 601/70 |
| 1,817,077 | 8/1931 | Gustaveson | 601/117 |
| 2,096,646 | 10/1937 | Thornton-Norris | 601/30 |
| 3,113,567 | 12/1963 | Russell | 601/51 |
| 3,587,588 | 6/1971 | Murr | 601/101 X |
| 4,085,738 | 4/1978 | Kodera | 601/103 X |
| 4,230,098 | 10/1980 | Uematsu | 601/115 X |
| 4,722,327 | 2/1988 | Harvey | 601/97 |
| 4,788,968 | 12/1988 | Rudashevsky et al. | 601/78 |
| 4,808,166 | 2/1989 | Davidov | 607/113 X |
| 4,834,075 | 5/1989 | Guo et al. | 601/89 |

FOREIGN PATENT DOCUMENTS

| | | | |
|---|---|---|---|
| 372114 | 6/1990 | European Pat. Off. | 601/103 |
| 405208038 | 8/1993 | Japan | 601/84 |
| 2012322 | 5/1994 | Russian Federation | 601/97 |
| 813352 | 5/1959 | United Kingdom | 601/30 |

*Primary Examiner*—Danton D. DeMille
*Assistant Examiner*—Brian Hanlon
*Attorney, Agent, or Firm*—Keck, Mahin & Cate

[57] ABSTRACT

A physical therapeutic instrument for treatment of hemorrhoids is disclosed. The instrument treats existing hemorrhoids through a nonoperative method and prevents possible anal diseases. The instrument has a rectal insert having a shape agreeable to the anal anatomy of the human body. The rectal insert is carried on a carriage and is movably orthogonally received in a through hole of a seat of the instrument. The rectal insert is lifted and inserted into the rectum by a lifting unit and vibrated vertically and/or horizontally by a vibration unit. The rectal insert also heats the rectum at about 36°–60° C., thus providing a heating effect for the rectum. Insertion of the rectal insert into the rectum also pushes up drooping anal sphincter muscles, thus strengthening the anal muscles. The instrument thus maintains and strengthens active contractible motion of the anal muscles.

4 Claims, 5 Drawing Sheets

PHYSICAL THERAPEUTIC INSTRUMENT FOR PREVENTION AND TREATMENT OF HEMORRHOIDS

FIELD OF THE INVENTION

The present invention relates in general to the prevention and treatment of hemorrhoids and, more particularly, to a physical therapeutic instrument for the prevention and treatment of hemorrhoids by stimulating good circulation of blood in the human anal area by producing a smooth massage and heating effect.

DESCRIPTION OF THE BACKGROUND

Hemorrhoids or piles are swollen varicose veins in the mucous membrane inside or just outside the rectum.

Excessive pressure due to constipation can cause a fold of the membranous rectal lining to slip down, thus pinching and irritating the veins. Many pregnant women experience hemorrhoidal problems because of pressure in the veins of the lower body area. Diseases of the digestive tract resulting in anal infection, and cirrhosis of the liver which obstructs blood circulation, can cause a hemorrhoidal problem.

Hemorrhoids can further deteriorate or rupture with additional pressure during constipation and straining at stool, or by external pressure because of long sitting when the piles are external.

Warm baths, suppositories, surgery, injection chemotherapy and many other types of therapy are shown to control bleeding and to eliminate the varicose veins.

Conventionally, several nonoperative methods have been proposed for treating hemorrhoids.

For instance, Japanese Patent Publication No., Sho. 50-6757 discloses a therapeutic rectal insert for treatment of hemorrhoids. The Japanese therapeutic rectal insert is a substantially cylindrical-shaped insert charged with a refrigerant. The rectal insert charged with a refrigerant is inserted into the rectum of a patient suffering from hemorrhoids and is intended to achieve treatment and relief of inflammation and pain caused by the hemorrhoids of the rectum. However, this Japanese therapeutic rectal insert merely achieves shrinking of existing hemorrhoids and relieves pain caused by the hemorrhoids, but is ineffective in the prevention of hemorrhoids.

Korean Utility Model Laid-open Publication No. 94-2718 discloses a therapeutic instrument for the treatment and prevention of hemorrhoids. The Korean instrument includes a thermal pad having a rectal insert portion. When using the instrument for treating or preventing hemorrhoids, the rectal insert portion of the thermal pad is inserted into the rectum and heats the rectum at about 40° C., thus having a heating effect on the rectum. This therapeutic instrument has a heating effect; however, it provides no effect other than the heating effect on the rectum.

On the other hand, U.S. Pat. No. 4,563,182 discloses a method and apparatus of treating hemorrhoids. The method of treating hemorrhoids comprises the steps of inserting into the rectum of a patient afflicted with the hemorrhoids a substantially cylindrical shaped insert, which consists of a water swellable polymer having a water content of at least 35% by weight, the insert having previously been frozen by being subjected to a temperature below 0° C. for sufficient amount of time to freeze the free water therein, and maintaining the insert with at least a portion thereof outside the sphincter muscle. However, the method and apparatus of treating hemorrhoids of the above U.S. patent merely have an operational effect and construction similar to that of the above Japanese therapeutic rectal insert, except for providing a cold effect for the patient afflicted with hemorrhoids.

SUMMARY OF THE INVENTION

It is, therefore, an object of the present invention to provide a physical therapeutic apparatus for preventing and treating hemorrhoids, in which the above problems can be overcome, and a method for treating existing hemorrhoids through a nonoperative method with low cost and little pain and which method, furthermore, prevents possible anal diseases.

In order to accomplish the above object, the present invention provides a physical therapeutic instrument for the prevention and treatment of hemorrhoids. The instrument has a rectal insert having a shape conforming to the anal anatomy of the human body. The rectal insert of the physical therapeutic instrument is inserted into the rectum of a patient afflicted with hemorrhoids and vibrated vertically and/or horizontally by a vibration unit, thus stimulating the anal sphincter muscles of the hemorrhoidal patient. The rectal insert also heats the rectum at about 36°–60° C., thus providing a heating effect for the rectum.

As the rectal insert of the instant instrument is inserted into the rectum of the hemorrhoidal patient and is vibrated in the rectum so as to stimulate the rectum, the thrombi in the veins about the anal area are dissolved. The dissolved thrombi will be smoothly circulated in the veins of the anal area, thus treating the thrombosis of the veins of the anal area.

Insertion of the rectal insert of the instant instrument also stimulates weak anal sphincter muscles, thus strengthening the anal muscles. The instrument of the invention thus maintains and strengthens active contractible motion of the anal muscles, so that the instrument not only treats the existing hemorrhoids but also prevents possible anal diseases.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
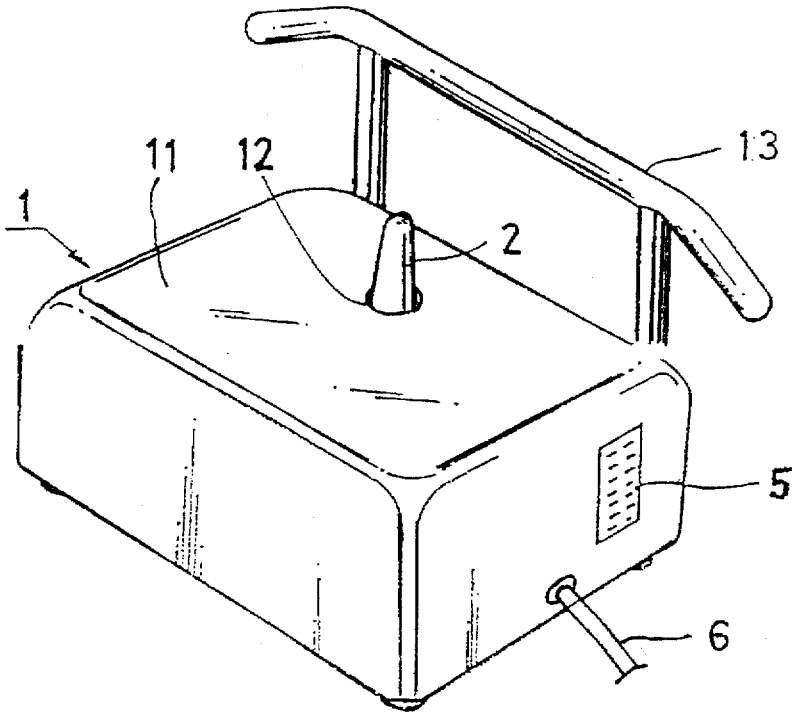
FIG. 1 is a perspective view of a physical therapeutic instrument for the prevention and treatment of hemorrhoids in accordance with the present invention.
Figure 2:
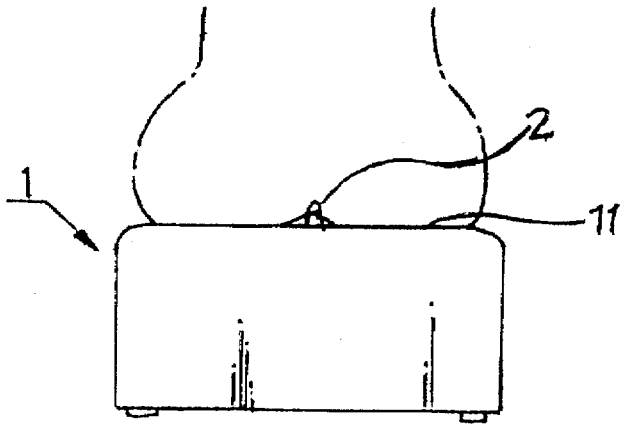
FIG. 2 is a schematic view showing insertion of a rectal insert of the instrument of FIG. 1 into the rectum of a user on a seat of the instrument.

FIG. 1 shows a physical therapeutic instrument for the prevention and treatment of hemorrhoids, of the present invention, and FIG. 2 shows a rectal insert of the instrument of FIG. 1 inserted into the rectum of a user seated on a seat of the instrument.

Figure 3:
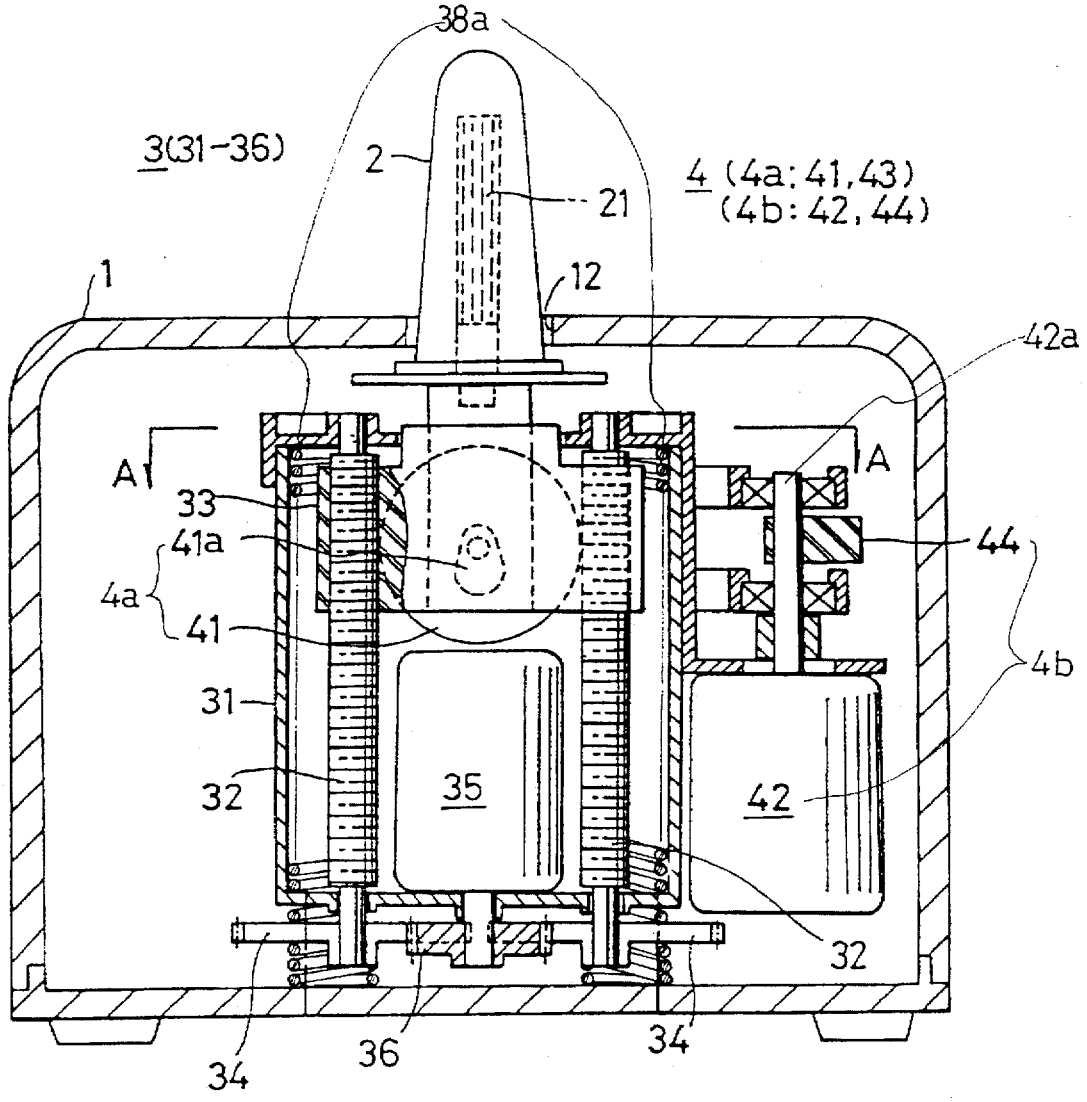
FIG. 3 is a sectional view showing a physical therapeutic instrument having a rectal insert lifting unit and a rectal insert vibrating unit in accordance with a first embodiment of the present invention.

In the drawings, the reference numeral 1 denotes a main body of the physical therapeutic instrument. The main body 1 has a seat 11 which is suitable for sitting thereon. Seat 11 has a through hole 12 in its center. The center through hole 12 of seat 11 orthogonally receives a movable rectal insert 2, which has a substantially conical shape so as to be simply and smoothly inserted into the rectum of a user, for example, a patient afflicted with hemorrhoids. When treating hemorrhoids using the above instrument, the hemorrhoidal patient is seated on the seat 11 of the instrument. In this state, rectal insert 2 is lifted up by the action of a rectal insert lifting unit 3 (as shown in FIG. 3) to an appropriate height conforming to the anal anatomy of the hemorrhoidal patient, so that insert 2 projects out of through hole 12 of the seat 11 and is inserted into the rectum of the patient. After insertion of the rectal insert 2 into the rectum of the patient, rectal insert 2 is vibrated by the action of a rectal insert vibrating unit 4 (see FIG. 3), thus stimulating the anal sphincter muscles of the hemorrhoidal patient and treating the hemorrhoids.

Erected on the back of the seat 11 is a back frame 13. The physical therapeutic instrument also includes a control panel 5 and a power cord 6 on a side wall of the main body 1. The control panel 5 for controlling operation of a heating wire 21 of the rectal insert 2 is exteriorly mounted on the side wall of the body 1, while the power cord 6 extends from the body 1 through the side wall of the body 1 to an outside power source (not shown).

Figure 4:
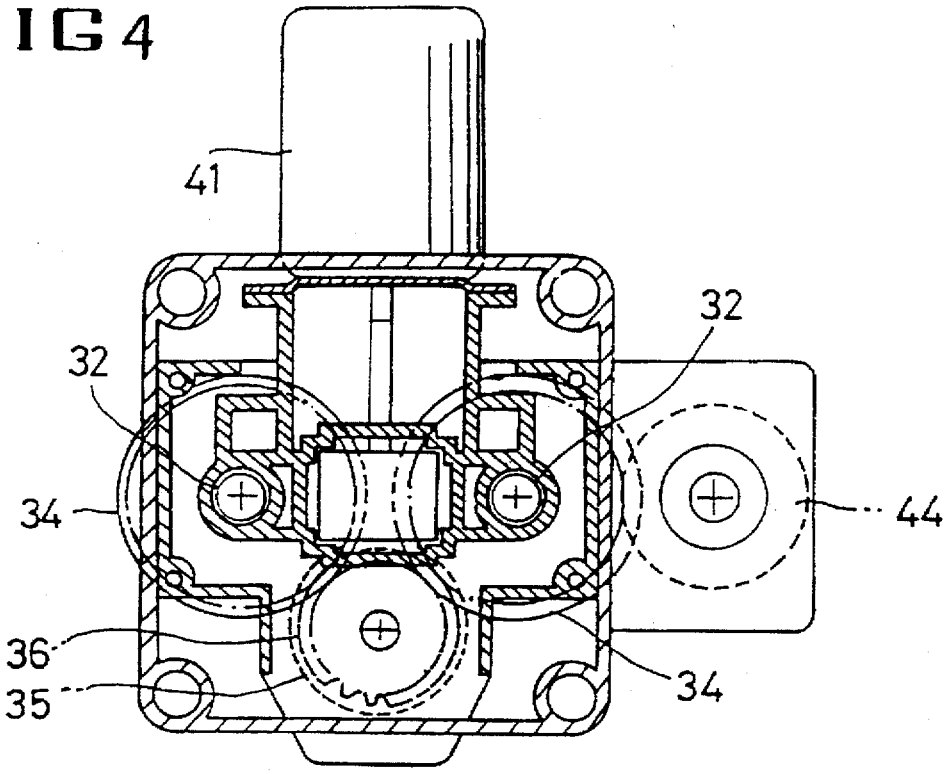
FIG. 4 is a sectional view of the rectal insert lifting unit of the instrument taken along the section line A—A of FIG. 3.
Figure 5:
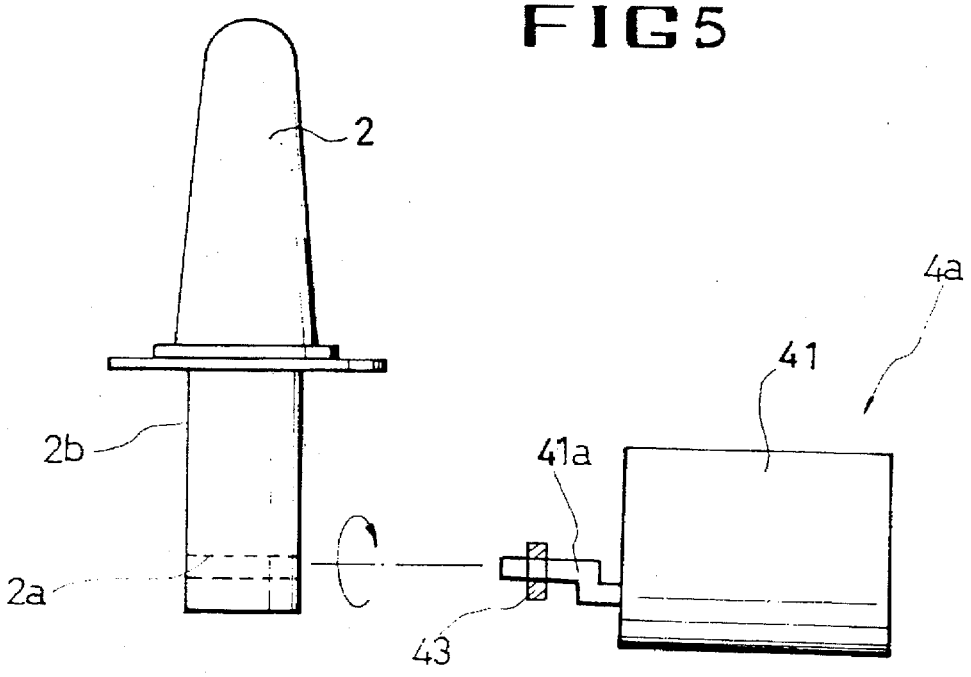
FIG. 5 is an exploded view of the rectal insert and a motor of a vertical vibration part of the rectal insert vibrating unit of the instrument of FIG. 3.

FIG. 3 shows construction of lifting unit 3 and vibrating unit 4 in accordance with a first embodiment of the invention, FIG. 4 shows the lifting unit 3 taken along the section line A—A of FIG. 3, and FIG. 5 shows the rectal insert 2 and a motor 41 of a vertical vibration part of the vibrating unit 4.

As shown in FIG. 3, heating wire 21 is set in the rectal insert 2 and electrically connected to the control panel 5 and to the power cord 6.

Heating wire 21 is controlled in its heating temperature within the range of 36° C.–65° C. Temperature 36° C. is equal to the temperature of the human body. The heating temperature of the heating wire 21 is set to about 36° C. when the instrument is used for the prevention of possible hemorrhoids or when a user wants to be comfortable during the insertion of the rectal insert 2 into the rectum, or when the instrument is used for relieving the pain of the hemorrhoidal patient. However, when the instrument is used for treatment of existing hemorrhoids, the heating temperature of heating wire 21 will be raised to a temperature above 36° C.

The heating temperature of the heating wire 21 is appropriately controlled by the control panel 5 in accordance with the requirements of the users, the condition of the hemorrhoids, and the severity of the anal disease.

As shown in FIGS. 3 and 4, lifting unit 3 is adapted for lifting up or lowering the rectal insert 2 and includes a pair of screw columns 32. The two screw columns 32 are vertically placed in parallel in a housing 31 of the unit 3, so that columns 32 can revolve on their vertical axes respectively. The two screw columns 32 are thoroughly engaged with their associated inner-threaded holes formed in opposed side sections of a rectal insert carriage 33. The bottom ends of the two screw columns 32 protrude out of the bottom of the housing 31 and are tightly coupled to their associated driven gears 34. A vertical motor 35 is placed between the two screw columns 32 on the bottom of the housing 31. The output rotating shaft of the vertical motor 35 extends downward from the bottom of the motor 35 to the outside of the housing 31. In the outside of the housing 31, the rotating shaft of the motor 35 is tightly coupled to a drive gear 36. The drive gear 36 commonly gears into the two driven gears 34 of the screw columns 32.

The vertical motor 35 is a reversible motor, so that the columns 32 revolve on their axes in a forward direction relative to the carriage 33 when the motor 35 is rotated in the forward direction. In this case, carriage 33 will thus travel up the revolving screw columns 32. However, the carriage 33 will travel down the screw columns 32 when the motor 35 is rotated in reverse direction. That is, when the motor 35 is rotated in either direction, the drive gear 36 is rotated by the rotating force of the motor 35 and rotates the drive gears 34 gearing into the drive gear 36 and in turn lets the screw columns 32 revolve on their axes. Therefore, the carriage 33 engaged with the screw columns 32 will travel up or down the revolving screw columns 33. The rectal insert 2 is vertically mounted on the top surface of the carriage 33, so that the rectal insert 2 is raised or lowered in accordance with vertical reciprocation of the carriage 33. The lifting height of the rectal insert 2 is controlled by controlling the operation of the vertical motor 35.

As is well known to those skilled in the art, hips of women are often more plump than the hips of men, so that the anal region of men is lower than that of women when seated on the seat 11 of the instrument. Otherwise stated, when seated on the seat 11, there is a difference of the height of the anal region from the seat 11 between a man and a woman. In this regard, the inserted depth of the rectal insert 2 inserted into the rectum of a man will be different from that of the rectal insert 2 inserted into the rectum of a woman when the lifting height of the rectal insert 2 is not controlled in accordance with the sex of a user. In order to overcome the above problem, the lifting height of the rectal insert 2 may be controlled in accordance with the sex of a user.

Meanwhile, vibrating unit 4 is adapted for vibrating the rectal insert 2 and for stimulating the anal sphincter muscles. The vibrating unit 4 is generally divided into two parts, that is, a vertical vibration part **4*a* and a horizontal vibration part 4*b*. The vertical vibration part 4*a* vertically vibrates the rectal insert 2, while the horizontal vibration part 4*b* horizontally vibrates the rectal insert 2. The two vibration parts 4*a* and 4*b* are similar to each other in that they have their drive motors 41 and 42 and their pendulums 43 and 44 fitted over their motor output shafts, which shafts are eccentric shafts. In addition, either vibration part 4*a* or 4*b* totally vibrates the housing 31 along with the rectal insert 2. However, the two vibration parts 4*a* and 4*b* are different from each other in that the motor 41 of the vertical vibration part 4*a* is a horizontal motor, while the motor 42 of the horizontal vibration part 4*b* is a vertical motor. In addition, the vertical vibration part 4a is placed in an upper section of the housing 31, while the horizontal vibration part 4b is placed on the outside of a side wall of the housing 31**.

In order to elastically suspend the housing 31 of the lifting unit 3 in the main body 1 in such a manner that the housing can be vibrated vertically and/or horizontally relative to the main body 1 by the vibrating unit 4, a plurality of elastic supporting members or coil springs 38a are vertically placed on the interior surface of the bottom of the main body 1 as shown in FIG. 3. The coil springs 38a vertically extend in the housing 31 and the tops of the springs 38a are coupled to the interior surface of the top panel of the housing 31, so that the housing 31 is suspended in the main body 1.

As shown in FIG. 3, the horizontal vibration part 4b which is mounted to the side wall of the housing 31 has the vertical drive motor 42, the eccentric rotating shaft 42a of the motor 42, and the pendulum 44 fitted over the eccentric rotating shaft 42a. With the eccentric rotating shaft 42a and the pendulum 44, the housing 31 along with the rectal insert 2 can be vibrated horizontally when the motor 42 is rotated.

Turning to FIG. 5, the horizontal drive motor 41 of the vertical vibration part 4a has the eccentric rotating shaft 41a and the pendulum 43 fitted over the shaft 41a, which shaft 41a is coupled to a shaft hole 2a horizontally formed in a lower section of a shank 2b of the rectal insert 2. With the eccentric rotating shaft 41a, the rectal insert 2 along with the housing 31 will be vibrated vertically when the motor 41 is rotated.

In this first embodiment, the two vibration parts 4a and 4b may be operated selectively or simultaneously.

When the vertical vibration part 4a is exclusively operated, the rectal insert 2 is vibrated vertically relative tot he main body 1 of the instrument. On the contrary, when the horizontal vibration part 4b is exclusively operated, the rectal insert 2 is vibrated horizontally relative to the main body 1. When the two vibration parts 4a and 4b are operated simultaneously, the rectal insert 2 is vertically vibrated simultaneously with horizontally vibrated relative to the main body 1. Both the vibration velocity and the vibration frequency of the rectal insert 2 are appropriately controlled in accordance with the condition of the anal area of a user, that is, a patient afflicted with hemorrhoids or a user wanting to prevent possible hemorrhoids.

Figure 6:
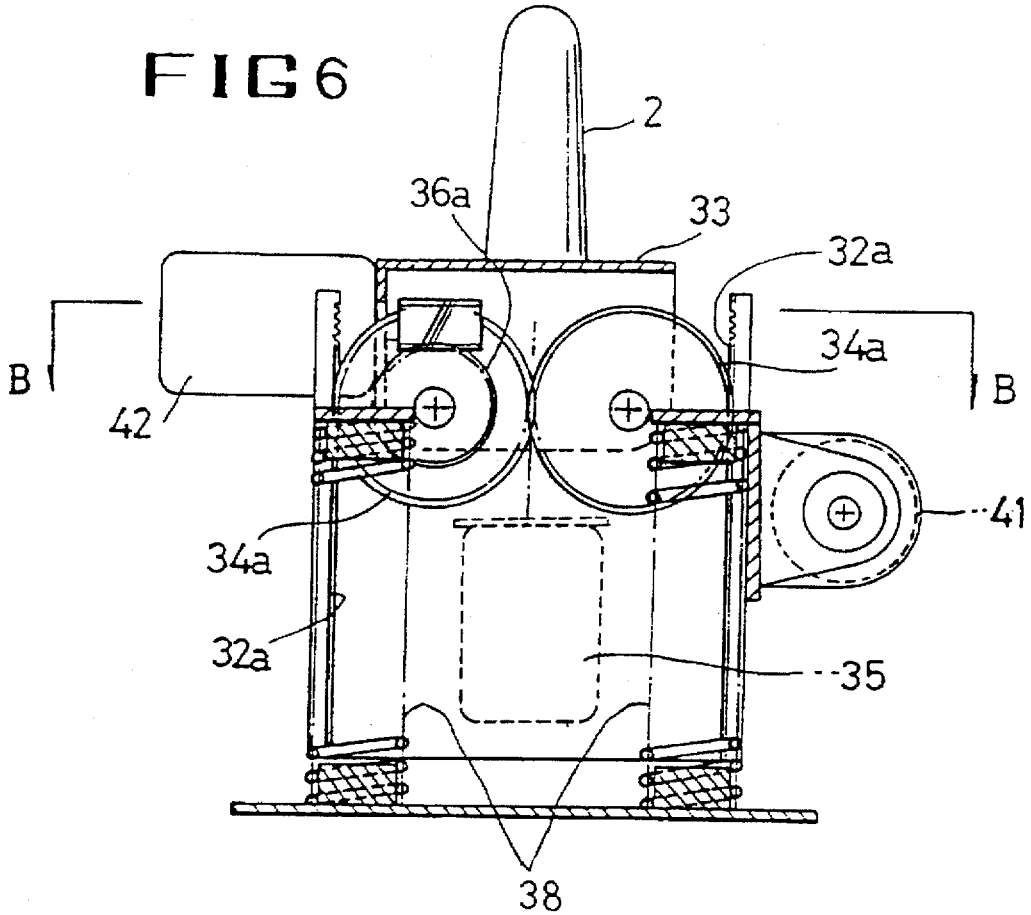
FIG. 6 is a sectional view of a rectal insert lifting unit of a physical therapeutic instrument for the prevention and treatment of hemorrhoids in accordance with a second embodiment of the present invention.
Figure 7:
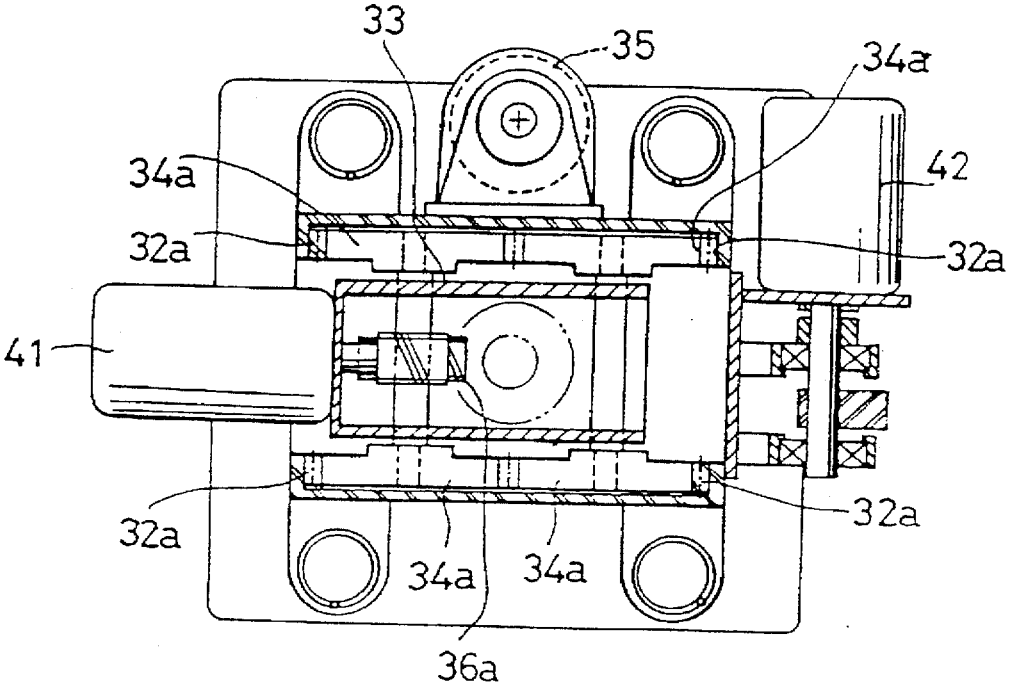
FIG. 7 is a sectional view of the rectal insert lifting unit of the instrument taken along the section line B—B of FIG. 6.

FIG. 6 shows a rectal insert lifting unit of a physical therapeutic instrument in accordance with a second embodiment of the present invention, and FIG. 7 shows a construction of the lifting unit of the instrument taken along the section line B—B of FIG. 6.

In this second embodiment, both the vertical vibration part 4a and the horizontal vibration part 4b of the rectal insert vibrating unit 4 use the drive motors 41 and 42 and the pendulums 43 and 44 fitted over the rotating shafts of the motors 41 and 42 in the same manner as described for the first embodiment. Therefore, the rectal insert vibrating operation for the vibrating unit 4 of this second embodiment is the same as in the first embodiment and further explanation is thus not deemed necessary. However, the construction of the rectal insert lifting unit is significantly altered as follows.

The lifting unit 3a of the second embodiment includes a pair of racks 32a and a pair of pinion gears 34a instead of the screw columns 32 and the driven gears 34 of the first embodiment. The racks 32a are vertically placed in parallel in the main body 1 of the instrument, while the pinion gears 34a are rotatable mounted to a rectal insert carriage 33. A drive motor 35 for driving the pinion gears 34a of the carriage 33 is carried on the carriage 33. The two pinion gears 34a gear into a drive gear 36a, which gear 36a is connected to a rotating shaft of the drive motor 35.

The lifting unit 3a of the second embodiment is characterized in that all of the drive motor 35, the two pinion gears 34a and the drive gear 36 are moved vertically along with the carriage 33 when vertically reciprocating the rectal insert 2 relative to the main body 1. That is, the drive motor 35 is a reversible motor that is rotated in either direction, and the two pinion gears 34a are applied with the rotating force of the motor 35 through the drive gear 36a, so that the pinion gears 34a gearing into the racks 32a are rotated relative to the vertical racks 32a. The rotating pinion gears 32a thus let the carriage 33 along with the rectal insert 2 go up or down the racks 32a.

A plurality of elastic supporting members or coil springs 38 for suspending the carriage 33 in the main body 1 and for assisting the returning motion of the carriage 33 are vertically placed on the bottom of the main body 1 of the instrument. The tops of the coil springs 38 are coupled to the lower surfaces of collars, which collars are horizontally provided on opposed sides of the carriage 33, so that the carriage 33 is suspended in the main body 1.

Figure 8:
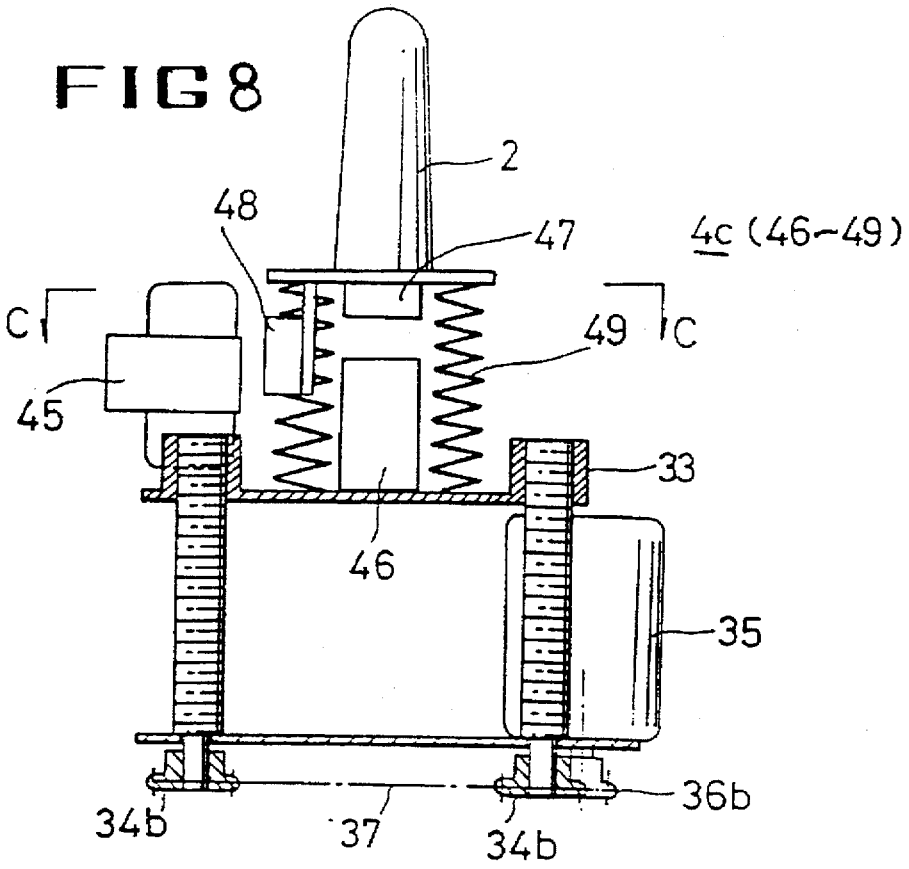
FIG. 8 is a sectional view of a rectal insert lifting unit and a rectal insert vibrating unit of a physical therapeutic instrument for the prevention and treatment of hemorrhoids in accordance with a third embodiment of the present invention.
Figure 9:
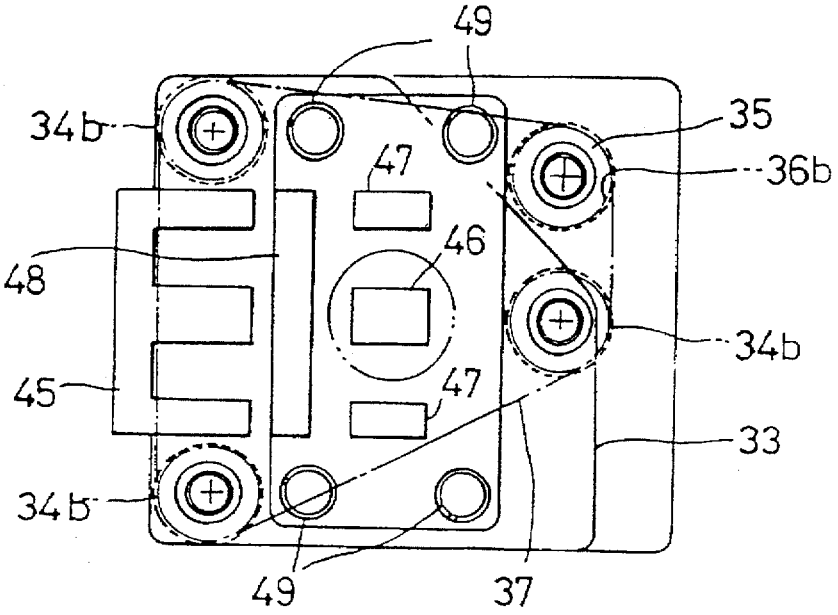
FIG. 9 is a sectional view of the rectal insert lifting unit of the instrument taken along the section line C—C of FIG. 8.

FIG. 8 shows a rectal insert lifting unit and a rectal insert vibrating unit of a physical therapeutic instrument in accordance with a third embodiment of the present invention, and FIG. 9 shows a construction of the lifting unit taken along the section line C—C of FIG. 8.

In this third embodiment, the general shape of the lifting unit 3b remains the same as in the first embodiment, but the driven gears 34 and the drive gear 36 are substituted with a plurality of driven chain sprockets 34b and a drive chain sprocket 36b, respectively. In addition, an endless chain 37 is commonly wrapped about the chain sprockets 34b and 36b.

The vibrating unit of the third embodiment is significantly different from those of the first and second embodiments. That is, both the horizontal vibration part and the vertical vibration part of the vibrating unit 4c of the third embodiment use electromagnets 45 and 46 as their drive sources. A plurality of elastic supporting members or coil springs 49 for suspending the rectal insert 2 in the main body 1 are vertically placed on the top surface of a rectal insert carriage 33. The tops of the springs 49 are coupled to the lower surface of a bottom plate of the rectal insert 2, thus suspending the rectal insert 2 in the main body 1. The vibrating unit 4c also includes a vertically magnetized body 47 and a horizontally magnetized body 48. The magnetized bodies 47 and 48 are mounted to the lower surface of the bottom plate of the rectal insert 2 and to the side of one of the coil springs 49 respectively. The magnetized bodies 47 and 48 are vertically vibrated and horizontally vibrated respectively due to magnetic attraction and magnetic repulsion generated between the magnetized bodies 47 and 48 and their associated electromagnets 46 and 45.

In the vibrating unit 4c, the vertical vibration electromagnet 46 is mounted to the center of the top surface of the carriage 33, while the horizontal vibration electromagnet 45 is mounted to the carriage 33 in the outside of the coil springs 49.

When the vertical vibration electromagnet 46 is exclusively supplied with electric current, the vertically magnetized body 47 is repeatedly magnetically attracted and repulsed by the electromagnet 46 and the rectal insert 2 is vibrated vertically relative to the main body 1 of the instrument. When the horizontal vibration magnet 45 is exclusively supplied with electric current, the horizontally magnetized body 48 is repeatedly magnetically attracted and repulsed by the electromagnet 45 and the rectal insert 2 is vibrated horizontally relative to the main body 1. When the two vibration electromagnets 45 and 46 are supplied with electric current simultaneously, the horizontally magnetized body 48 and the vertically magnetized body 47 are vibrated horizontally and vertically respectively along with the rectal insert 2.

When the rectal insert 2 of a physical therapeutic instrument in accordance with either of the above first to third embodiments of the invention is not used, it is preferred to completely retract the rectal insert 2 into the center through hole 12 of the seat 11, thus to hide the rectal insert 2 in the main body 1 and to keep the insert 2 from sight. When using the rectal insert 2 of the instrument for treating or preventing anal diseases such as hemorrhoids, the user sits on the seat 11 of the main body 1 and appropriately raises the rectal insert 2 by operating the lifting unit 3, thus permitting the rectal insert 2 to appear out of the center through hole 12 and permitting the rectal insert 2 to be inserted into the rectum of the user.

When inserting the rectal insert 2 into the rectum, the user determines the lifting height of the insert 2 out of the through hole 12 and stops the lifting unit 3 when the insert 2 has been inserted into the rectum to an appropriate depth. After insertion of the rectal insert 2 into the rectum, the control panel 5 is set to control the temperature of the heating wire 21 of the rectal insert 2, thus heating the insert 2 to a temperature suitable for treating or preventing anal diseases such as hemorrhoids. Of course, the control panel 5 may be set before the insertion of the rectal insert 2 into the rectum.

Thereafter, the vertical vibration part **4*a* and the horizontal vibration part 4*b* are operated selectively or simultaneously to vibrate the rectal insert 2 in the rectum. The rectal insert 2 thus stimulates the anal sphincter muscles of the user, so that thrombi in the veins of the anal area are dissolved. The dissolved thrombi will be smoothly circulated in the veins of the anal area, thus treating the thrombosis of the veins of the anal area. Insertion of the rectal insert 2** of the instant instrument also stimulates weak anal sphincter muscles, thus strengthening the anal muscles. The instrument of the present invention thus maintains and strengthens active contractible motion of the anal muscles, so that the instrument not only treats existing hemorrhoids but also prevents possible anal disease.

EXAMPLE

Forty-nine cases of hemorrhoids were treated using the instrument of the invention and the therapeutic results are given in the following Table:

TABLE

| SEX | SYMPTOMS | SYMPTOM PERIOD BEFORE TREATMENT | RESULTS | TREATMENT TIMES (with this instrument) |
|---|---|---|---|---|
| Man | External H. | 6 months | Healthy | 5 |
| Man | Degree 1 H. | 3 years | Improved | 14 |
| Man | Degree 1 H. | 2 years | Improved | 10 |
| Woman | Degree 1 H. | 5 years | Improved | 14 |
| Woman | External H. | 3 months | Healthy | 5 |
| Man | External H. | 1 month | Healthy | 3 |
| Woman | Degree 1 H. | 2 years | Improved | 10 |
| Man | Degree 1 H. | 2 years | Improved | 10 |

TABLE-continued

| SEX | SYMPTOMS | SYMPTOM PERIOD BEFORE TREATMENT | RESULTS | TREATMENT TIMES (with this instrument) |
|---|---|---|---|---|
| Man | Degree 1 H. | 3 years | Improved | 14 |
| Man | External H. | 5 months | Healthy | 3 |
| Woman | External H. | 1 month | Healthy | 3 |
| Woman | Degree 1 H. | 4 years | Improved | 14 |
| Man | Degree 1 H. | 4 years | Improved | 14 |
| Woman | Degree 1 H. | 3.5 years | Improved | 14 |
| Woman | External H. | 3 months | Healthy | 5 |
| Man | Degree 1 H. | 4 years | Healthy | 14 |
| Man | Degree 1 H. | 3.5 years | Healthy | 14 |
| Man | Degree 1 H. | 3 years | Healthy | 10 |
| Man | Degree 1 H. | 2 years | Healthy | 10 |
| Woman | External H. | 8 months | Healthy | 7 |
| Man | Degree 1 H. | 3 years | Healthy | 14 |
| Man | Degree 1 H. | 2 years | Healthy | 10 |
| Man | External H. | 1 month | Healthy | 3 |
| Man | Degree 1 H. | 3 years | Healthy | 14 |
| Man | Degree 1 H. | 4 years | Healthy | 14 |
| Man | External H. | 6 months | Healthy | 3 |
| Woman | Degree 1 H. | 3 years | Healthy | 14 |
| Man | External H. | 6 months | Healthy | 3 |
| Man | Degree 2 H. | 4 years | Healthy | 17 |
| Man | Degree 1 H. | 3 years | Healthy | 14 |
| Woman | Degree 2 H. | 2 years | Healthy | 10 |
| Man | Degree 2 H. | 5 years | Healthy | 14 |
| Woman | External H. | 3 months | Healthy | 2 |
| Man | Degree 1 H. | 2 years | Healthy | 10 |
| Woman | External H. | 5 months | Healthy | 3 |
| Woman | Degree 1 H. | 2 yews | Healthy | 10 |
| Woman | External H. | 2 years | Healthy | 7 |
| Woman | External H. | 2 years | Healthy | 7 |
| Man | External H. | 6 months | Healthy | 5 |
| Man | External H. | 6 months | Healthy | 3 |
| Woman | Degree 2 H. | 5 years | Healthy | 19 |
| Woman | Degree 1 H. | 3 years | Healthy | 14 |
| Man | External H. | 6 months | Healthy | 3 |
| Woman | External H. | 1 year | Healthy | 7 |
| Man | Degree 1 H. | 3 years | Healthy | 14 |
| Woman | Degree 1 H. | 3 years | Healthy | 10 |
| Man | External H. | 6 months | Healthy | 3 |
| Woman | Degree 1 H. | 6 months | Healthy | 10 |
| Woman | External H. | 2 months | Healthy | 3 |

As described above, a physical therapeutic instrument for the prevention and treatment of hemorrhoids of the present invention stimulates the anal sphincter muscles and dissolves thrombi in the veins of the anal area and lets the dissolved thrombi be smoothly circulated in the veins of the anal area, thus treating thrombosis of the veins of the anal area. Insertion of the rectal insert of the instant instrument also stimulates weak anal sphincter muscles and strengthens the anal muscles. The physical therapeutic instrument of the invention permits active contractible motion of the anal muscles, thereby not only treating existing hemorrhoids but also preventing possible anal diseases.

Although preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A physical therapeutic instrument for the prevention and treatment of hemorrhoids comprising:

a main body provided with a through hole in its center;

a movable rectal insert having a substantially conical shape, said rectal insert being carried on a rectal insert carriage and said rectal insert being movably orthogonally received in said through hole of said main body;

a lifting unit for vertically reciprocating said carriage together with said rectal insert, said lifting unit being located in said main body, said lifting unit comprising:

a housing movably placed in said main body;

a pair of screw columns vertically placed in parallel in said housing and revolving on their vertical axes respectively, said rectal insert carriage engaged with said screw columns at opposed side sections of said rectal insert carriage and vertically reciprocating in accordance with revolving motions of said screw columns;

a drive motor for generating a rotating force for said screw columns;

a drive gear coupled to a rotating shaft of said drive motor; and a pair of driven gears each being coupled to a bottom end of one of said screw columns;

wherein said drive gear gears into said driven gears; and a vibrating unit for vibrating said rectal insert, said vibrating unit being located in said main body;

wherein the movable rectal insert is vibrated by the vibrating unit in at least one direction selected from a vertical direction and a horizontal direction.

2. The physical therapeutic instrument according to claim 1, wherein said rectal insert comprises a heating wire therein, said heating wire being controlled in its heating temperature by a control panel.

3. The physical therapeutic instrument according to claim 1, wherein said vibrating unit comprises:

a vertical vibration part for vertically vibrating said rectal insert; and a horizontal vibration part for horizontally vibrating said rectal insert.

4. The physical therapeutic instrument according to claim 3, wherein said vertical vibration part comprises:

a motor mounted within the housing, wherein said motor provides vertical vibration; and a pendulum fitted over a rotating shaft of said motor.

* * * * *